US006965391B2

(12) United States Patent
Giacca

(10) Patent No.: US 6,965,391 B2
(45) Date of Patent: Nov. 15, 2005

(54) THERMAL TRANSFER RIBBON ACTUATION DEVICE FOR PRINTING MACHINES

(75) Inventor: Mirko Penzo Giacca, Barcelona (ES)

(73) Assignee: I.T.W. Espana, S.A., Barcelona (ES)

( * ) Notice: Subject to any disclaimer, the term of this patent is extended or adjusted under 35 U.S.C. 154(b) by 129 days.

(21) Appl. No.: 10/763,265

(22) Filed: Jan. 26, 2004

(65) Prior Publication Data

US 2004/0150706 A1 Aug. 5, 2004

(30) Foreign Application Priority Data

Jan. 27, 2003 (ES) ..... 200300193

(51) Int. Cl.[7] ..... B41J 33/34

(52) U.S. Cl. ..... 347/217; 400/225; 400/231; 400/229

(58) Field of Search ..... 347/215, 217; 400/223, 225, 227, 229, 231, 233

(56) References Cited

U.S. PATENT DOCUMENTS 5,600,360 A * 2/1997 Lerner et al. ..... 347/171

FOREIGN PATENT DOCUMENTS

DE 3834161 * 4/1990 ..... B41J 33/34
JP 62-278409 * 12/1987 ..... B41J 33/38

* cited by examiner

*Primary Examiner*—Huan Tran
(74) *Attorney, Agent, or Firm*—Lowe Hauptman & Berner, LLP

(57) ABSTRACT

Applicable to machines having a moving carriage (4) that can move transversally with respect to the continuous band to be printed and that includes a thermal printing head (9) by which passes a thermal ribbon, from a cassette of origin (5) to a destination cassette (10), which pulls said ribbon (7), its characteristics centred on the fact that the drive motor for said ribbon (7) instead of being established on the moving carriage (4) is established on the fixed plate (3) along which the aforementioned carriage may travel, for which purpose said motor acts directly or indirectly on a roller (12) mounted on the fixed plate (3), aided by a return roller (14) to establish a transmission belt (14) which bends in its path due to a pair of auxiliary rollers (16–16') mounted free to revolve about the carriage (4), by which bend the belt (13) is connected to a drive roller (15) that is also mounted on the carriage (4), which transmits the motion to the pulling cassette (10) by a transmission belt (20) and by a clutch mechanism such that the rotation of said drive roller (15) is only transmitted to the cassette (10) when the aforementioned motor is working.

4 Claims, 4 Drawing Sheets

A-B

THERMAL TRANSFER RIBBON ACTUATION DEVICE FOR PRINTING MACHINES

OBJECT OF THE INVENTION

The present invention relates to a device meant to actuate intermittently the thermal transfer ribbon used by certain printing machines, such as label and/or film printing machines, in which printing must be performed intermittently on clusters or printing areas suitably established on a continuous strip that moves longitudinally and transversally to the printing element, as well as intermittently, during the printing.

The object of the invention is to improve the overall performance of the machine, specifically by increasing its printing speed without harming the printing quality and a simplification of the ribbon transport mechanism.

BACKGROUND OF THE INVENTION

In the field of the practical application of the invention, such as in printing clusters -printing areas- established on a continuous support band in which the clusters define transverse and longitudinal alignments, evenly separated or otherwise, printing machines are used in which the aforementioned continuous band to be printed moves longitudinally under a fixed plate, on which in turn moves transversally a moving carriage, aided by the corresponding motor, which carries a cassette feeding the thermal transfer ribbon that passes the printing area and is collected at a destination cassette, which is also motorised to pull on the ribbon when the printing must take place. Thus, the thermal transfer ribbon advances when the moving carriage is placed opposite the printing clusters or areas corresponding to the labels or elements involved, and stops at the spaces defined between said clusters, all of this governed by the printing machine programming system.

Hitherto, in printing machines of this type the carriage actuation motor is mounted on the casing and the thermal transfer ribbon actuation motor is mounted on the carriage, with the resulting increase in mass and thus inertia of the carriage, implying a limitation of the operation speed as if the speed is increased the reliability of the carriage position is diminished.

On another hand, it is obvious that to obtain higher speeds greater size motors must be used, which will occupy more space on the carriage, also arming the operation of the machine as this requires disposing smaller ribbon feeding and collection cassettes, and thus shorter ribbons, shortening the machine's autonomy time.

DESCRIPTION OF THE INVENTION

The actuation device taught by the invention solves the above described drawbacks in a fully satisfactory manner.

For this purpose and more specifically, the essence of the invention is that the thermal transfer ribbon actuation motor is placed outside of the carriage, at any suitable place of the fixed plate.

According to another characteristic of the invention and in order to transmit the motion and maintain a constant interconnection between these fixed and moving elements, i.e. the motor and the carriage, a roller is disposed at each end part of the fixed plate, one roller receiving the motion from the motor while the other one revolves freely, the rollers being related by a transmission belt (optionally replaced by gears and a chain or any other transmission mechanism), which with the aid of a pair of freely revolving rollers suitably disposed on a side of the carriage bends at a point of its trajectory to engage another roller also disposed on the carriage, which is meant to transport the thermal transfer ribbon. The latter roller does not act directly on the thermal transfer ribbon but instead, by means of an interposed freely revolving wheel, does so on an elastomer roller that does act on the thermal transfer ribbon, with the property that the aforementioned freely revolving wheel is mounted inside the elastomer roller at an axial position so that, when the carriage advances to the first printing position the free wheel slides and the thermal transfer ribbon is not transported due to the mobility of the carriage, as occurs in the dead spaces defined between printing clusters.

The thermal transfer ribbon is transported directly by the elastomer roller and by a belt transmission connecting this roller to the destination shaft or collection shaft for the used thermal transfer ribbon.

DESCRIPTION OF THE DRAWINGS

As a complement of the description being given and in order to aid a better understanding of the characteristics of the invention, according to an example of a preferred embodiment, the description includes a set of drawings where for purposes of illustration only and in a non-limiting sense the following is shown.

PREFERRED EMBODIMENT OF THE INVENTION

Figure 1:
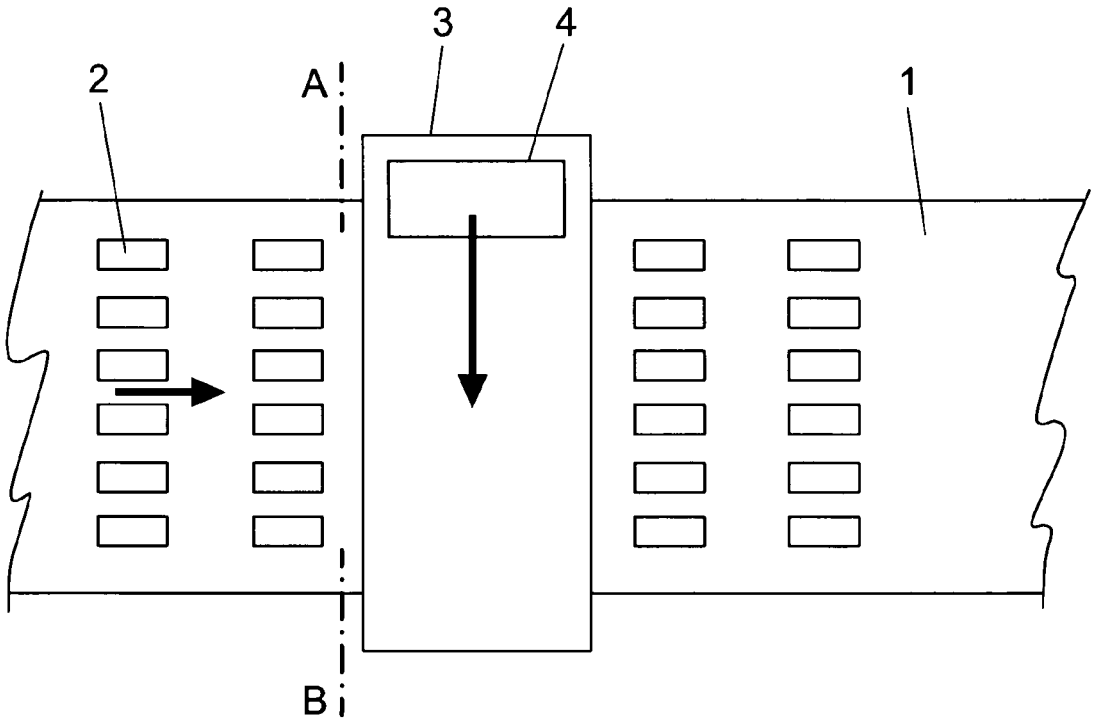
FIG. 1 shows a partial, schematic and plan view of a printing machine to which can be coupled the thermal transfer ribbon actuation device constituting the object of the present invention.

In view of the above-described figures, and more specifically FIG. 1, it can be seen that the device of the invention is intended for printing machines in which the elements to be printed, such as labels or film, are in the form of a continuous band (1) with a plurality of printing clusters (2) in vertical and transverse alignments, the printing clusters (2) being evenly distributed, or not, in both senses, the band (1) being able to move under a fixed plate (3) above which moves transversally a printing carriage (4) that can act sequentially on each transverse alignment of printing clusters (2), such carriage (4) incorporating a cassette (5) mounted free to revolve about a shaft (6) that feeds the thermal transfer ribbon (7), which suitably guided by rollers (8) passes through a thermal printing head (9) that can swivel downwards when it passes over the printing clusters (2), the ribbon being finally collected in a collection cassette (10) or destination cassette.

Figure 2:
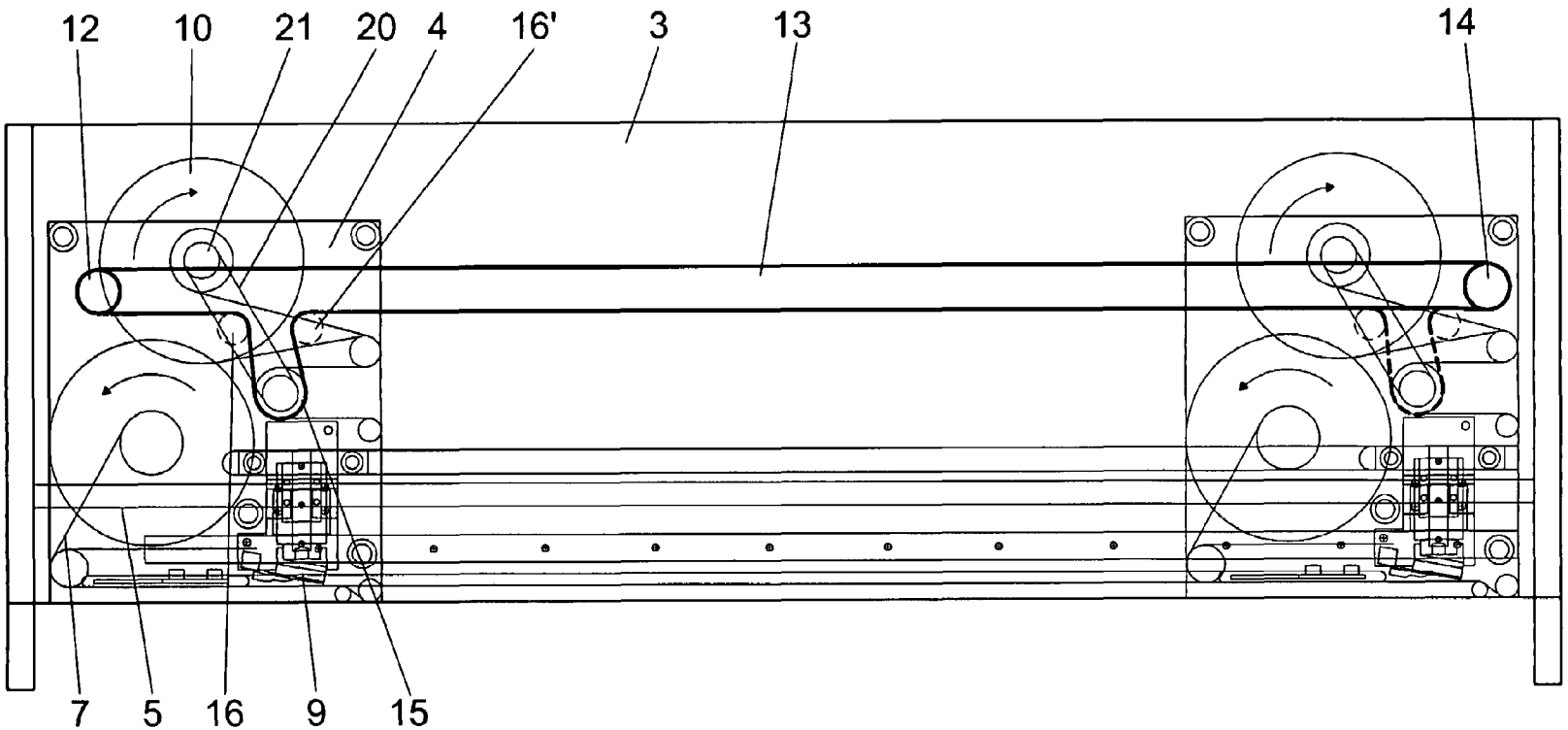
FIG. 2 shows an elevation view of the machine at the position of the carriage, along the A-B section line of FIG. 1, above which is highlighted the part of the actuation device of the invention relating the thermal transfer ribbon actuation motor with the transport means for the ribbon.
Figure 3:
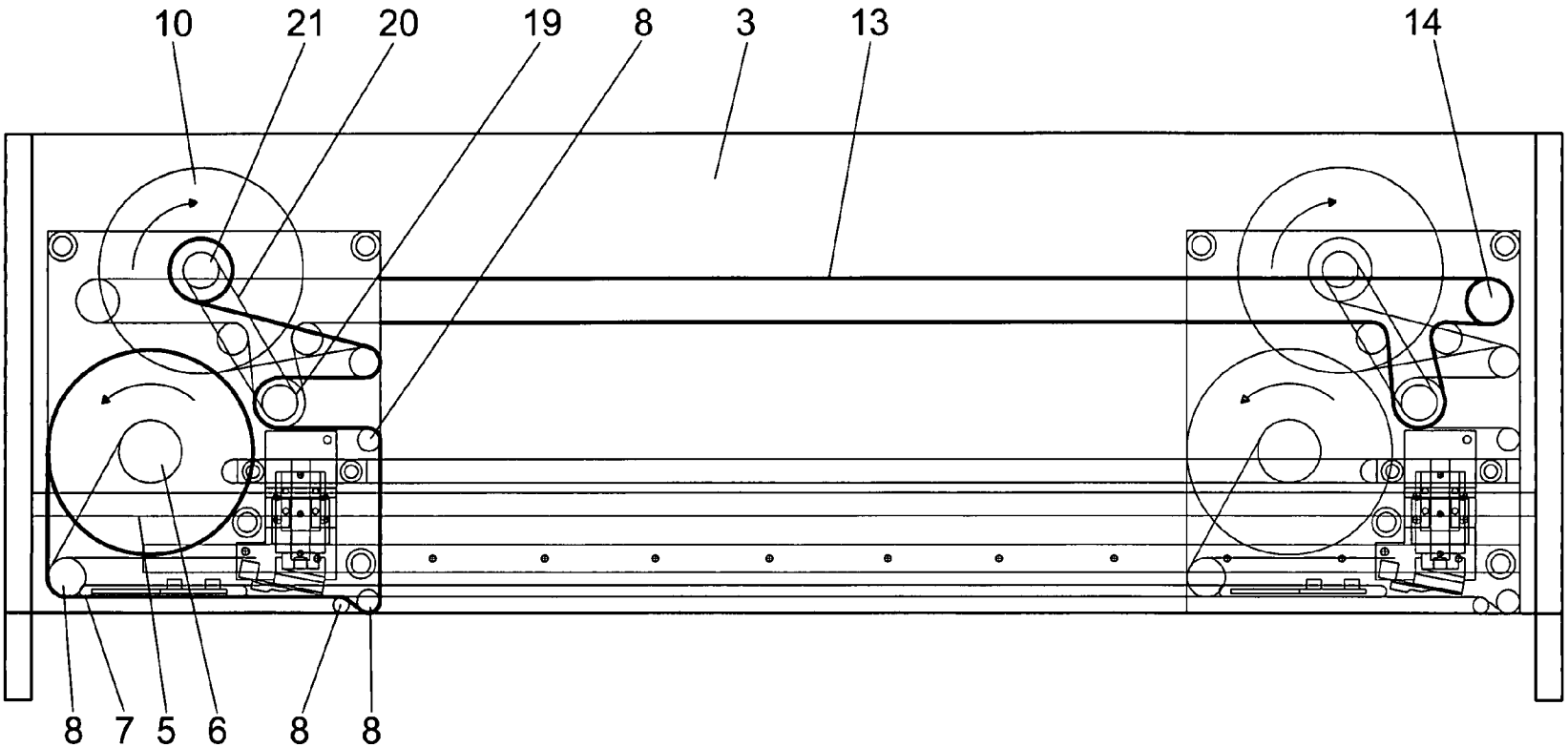
FIG. 3 shows a similar representation to FIG. 2 in which the path of the aforementioned thermal transfer ribbon is shown highlighted.
Figure 4:
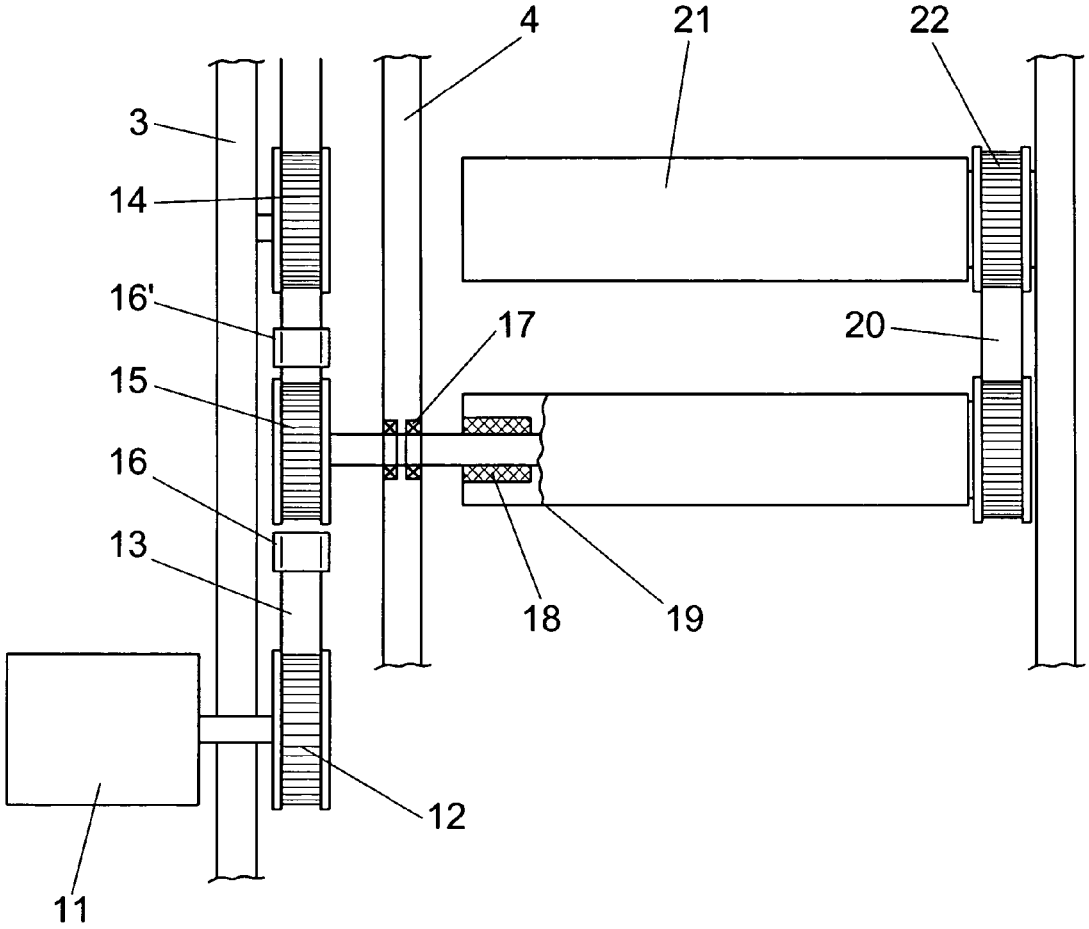
FIG. 4 shows, finally, a schematic plan view of the mechanical transmission between the thermal transfer ribbon actuation motor and the roller transporting the ribbon.

With this basic and conventional structure, the invention is based on that fact that the motor (11) actuating the ribbon (7) is placed out of the carriage, specifically at any suitable point of the fixed plate (3), and either directly or by a suitable transmission mechanism conveys the motion to a drive roller (12) also placed on the fixed plate (3), the roller (12) with the aid of a transmission element (13), such as a belt, and of a return roller (14) that is also free to revolve about the plate (3), transmitting the motion to a third roller (15) that is mounted in turn to the carriage (4), which is provided with a pair of auxiliary rollers (16–16') that cause the required deflection of the transmission belt or element (13) to reach the roller (15), as seen particularly in FIG. 2, the roller (15) receiving the motion from the belt (13) when the motor (11) is actuated, as will be seen below.

When the carriage (4) moves without the motor (11) being actuated, the thermal transfer ribbon (7) is not transported as the free wheel (18) turns freely on the inner surface of the elastomer roller (19). When the carriage (4) retracts, to prevent the transport of the thermal transfer ribbon (7) the motor (11) is actuated in the required sense. When the carriage (4) advances with the printing, as the thermal transfer ribbon (7) must be actuated the motor (11) is necessarily actuated.

Transport of the thermal transfer ribbon (7) is achieved by moving the elastomer roller (19), which by means of the belt (20) actuates the destination roller shaft (21), a friction element existing between the gear (22) and the shaft (21) that compensates tangential speeds resulting from the different diameters obtained when collecting the thermal transfer ribbon (7).

According to this construction and from an end position of the carriage (4), as shown in FIG. 1, the carriage will execute a transverse motion on the fixed plate (3), the continuous band (1) bearing the printing clusters (2) remaining still. Throughout this motion the thermal printing head (9) will remain raised and the motor (11) will be stopped, as in the spaces defined between the printing clusters (2), while when the carriage reaches each cluster (2) the thermal printing head (9) descends until contacting the continuous band (1) and the motor (11) starts to transport to thermal transfer ribbon (7), all of this according to the operation program established for the machine.

Disposing the motor (11) out of the carriage (4), specifically on the fixed plate (3), considerably reduces the weight of the carriage (4), in accordance with the object of the invention, thus allowing a higher speed of operation of the carriage and a lower inertia in the stoppages corresponding to the various printing clusters (2).

What is claimed is:

1. Thermal transfer ribbon actuation device for printing machines, specifically in machines incorporating a thermal printing head (9) established on a moving carriage (4) that travels along a fixed plate (3) and above a continuous band (1), which advances intermittently and bears the printing clusters (2) that define transverse alignments (with respect to the motion of the carriage) such as labels, films or the like, and in which said thermal printing head (9) employs a thermal transfer ribbon (7) supplied by a cassette of origin (5) and collected by a destination cassette (10) that acts as a transport mechanism for the ribbon (7), characterised in that the motor (11) transporting the aforementioned thermal transfer ribbon (7) is placed at any suitable place of the fixed plate (3), this is, out of the carriage (4), transmitting its motion directly or indirectly to a drive roller (12) also established on the fixed plate (3), which is aided by a return roller (14) also established on the fixed plate (3), the two rollers (12) and (14) being connected to each other by a transmission mechanism (13), such as a belt, which bends with the aid of a pair of auxiliary rollers (16–16'), mounted on the corresponding side of the carriage (4), in its path towards a drive roller (15) that is also mounted on the carriage (4), which conveys the motion to the destination cassette (10) when the thermal printing head (9) is operating, this is, in correspondence with the printing clusters established in the continuous band (1).

2. Thermal transfer ribbon actuation device for printing machines, according to claim 1, characterised in that the transport roller (15) is mounted free to turn on the corresponding wall of the of the carriage (4), and is joined to a freely revolving wheel (18) that moves inside an elastorner roller (14), arranged axially to it so that when the motor (11) is stopped and the roller (15) turns due to the longitudinal movement the carriage (4), its motion is not transmitted to the elastomer roller (19), while when the motor (11) is moving the free wheel (18) and the elastomer roller (19) engage, conveying a motion to the latter.

3. Thermal transfer ribbon actuation device for printing machines, according to claim 1, characterised in the elastomer roller (19) transmits the motion by means of a belt (20) or another suitable means of transmission to the shaft (21) of the drive cassette (10) of the thermal transfer ribbon (7).

4. Thermal transfer ribbon actuation device for printing machines, according to claim 3, characterised in that between the gear (22) and the shaft (21) of the drive cassette (10) of the thermal transfer ribbon (7) there is a friction element that compensates the tangential speeds resulting from the varying diameter.

* * * * *